US007389716B2

(12) United States Patent
Blume et al.

(10) Patent No.: US 7,389,716 B2
(45) **Date of Patent: *Jun. 24, 2008**

(54) CORE REDUCTION APPARATUS

(75) Inventors: Joseph A. Blume, Green Bay, WI (US); James Vincent Holzem, Oneida, WI (US); Steve J. Jansen, De Pere, WI (US)

(73) Assignee: Wausau Paper Towel & Tissue, LLC, Mosinee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/524,774

(22) Filed: Sep. 20, 2006

(65) Prior Publication Data

US 2007/0012150 A1 Jan. 18, 2007

Related U.S. Application Data

(60) Continuation of application No. 10/964,857, filed on Oct. 13, 2004, now Pat. No. 7,127,974, which is a division of application No. 10/384,436, filed on Mar. 7, 2003, now Pat. No. 7,107,888.

(51) Int. Cl.
*B65H 19/00* (2006.01)

(52) U.S. Cl. ..... 83/102; 83/151; 83/407

(58) Field of Classification Search ..... 83/27, 83/102, 151, 162, 418, 407, 425.4, 425.3, 83/422; 82/47, 101, 97; 242/527.2, 530.1
See application file for complete search history.

(56) References Cited

U.S. PATENT DOCUMENTS

| | | | | |
|---|---|---|---|---|
| 1,108,855 | A | 8/1914 | Simons | |
| 1,126,710 | A | 2/1915 | Conry | |
| 1,354,464 | A * | 10/1920 | Cameron et al. | 242/525.2 |
| 1,573,613 | A | 2/1926 | Johnstone | |
| 1,716,812 | A | 6/1929 | Ball | |
| 1,731,480 | A | 10/1929 | Wolfe | |
| 2,299,626 | A | 10/1942 | Hunt | |
| 2,366,999 | A | 1/1945 | Campbell | |
| 2,703,681 | A | 3/1955 | Jacobs | |
| 2,726,823 | A | 12/1955 | Jespersen | |
| 2,897,893 | A | 8/1959 | Rockstrom et al. | |
| 2,905,405 | A | 9/1959 | Burton et al. | |
| 3,084,006 | A | 4/1963 | Roemer | |

(Continued)

FOREIGN PATENT DOCUMENTS

| | | |
|---|---|---|
| GB | 2245882 | 1/1992 |

(Continued)

OTHER PUBLICATIONS

Copending U.S. Appl. No. 10/015,051, entitled "Double Core Tissue Roll, Dispenser and Method," filed Dec. 11, 2001.

*Primary Examiner*—Stephen Choi
(74) *Attorney, Agent, or Firm*—Merchant & Gould P.C.

(57) ABSTRACT

Apparatus and processes for producing paper roll products with spaced core sections. A core substrate is arranged on a mandrel, and then divided into a plurality of core sections. The core sections are then separated from each other on the mandrel to form gaps between the core sections. Paper web material can then be wound onto the separated core sections to form a log of rolls. The log is then cut into final paper roll products.

8 Claims, 11 Drawing Sheets

U.S. PATENT DOCUMENTS

| | | | |
|---|---|---|---|
| 3,085,762 | A | 4/1963 | Subklew |
| 3,114,198 | A | 12/1963 | Blanchet |
| 3,126,234 | A | 3/1964 | Batlas et al. |
| 3,211,504 | A | 10/1965 | Bump |
| 3,214,014 | A | 10/1965 | Perrin |
| 3,218,894 | A | 11/1965 | Chow |
| 3,224,700 | A | 12/1965 | Heinle |
| 3,294,329 | A | 12/1966 | Tucker et al. |
| 3,381,909 | A | 5/1968 | Tucker et al. |
| 3,387,902 | A | 6/1968 | Perrin et al. |
| 3,424,398 | A | 1/1969 | Garnier |
| 3,433,355 | A | 3/1969 | Smith |
| 3,437,388 | A | 4/1969 | Jespersen |
| 3,438,589 | A | 4/1969 | Jespersen |
| 3,538,802 | A | 11/1970 | Helm et al. |
| 3,650,487 | A | 3/1972 | Bahnsen |
| 4,108,513 | A | 8/1978 | Lander |
| 4,108,547 | A | 8/1978 | Stemmle |
| 4,269,091 | A | 5/1981 | Hodapp et al. |
| 4,329,895 | A | 5/1982 | Perini |
| 4,398,678 | A | 8/1983 | Kron et al. |
| 4,422,588 | A | 12/1983 | Nowisch |
| 4,522,346 | A | 6/1985 | Jespersen |
| 4,557,426 | A | 12/1985 | Siciliano |
| 4,635,871 | A | 1/1987 | Johnson et al. |
| 4,695,006 | A | 9/1987 | Pool |
| 4,875,632 | A | 10/1989 | Kataoka |
| 4,903,909 | A | 2/1990 | Suzuki |
| 5,214,988 | A | 6/1993 | Quigley |
| 5,236,141 | A | 8/1993 | Kewin |
| 5,310,129 | A | 5/1994 | Whittington et al. |
| 5,356,086 | A | 10/1994 | Takagi |
| 5,467,936 | A | 11/1995 | Moody |
| 5,605,001 | A | 2/1997 | Derk |
| 5,620,151 | A | 4/1997 | Ueyama et al. |
| 5,636,812 | A | 6/1997 | Conner et al. |
| 5,713,254 | A | 2/1998 | Pienta |
| 5,749,538 | A | 5/1998 | Brown et al. |
| 5,829,713 | A | 11/1998 | Kewin |
| 5,833,169 | A | 11/1998 | Morand |
| 6,000,657 | A | 12/1999 | Butterworth |
| 6,051,092 | A | 4/2000 | Lynch et al. |
| 6,129,304 | A | 10/2000 | Biagiotti |
| 6,302,352 | B1 | 10/2001 | Applegate |
| 6,386,479 | B1 | 5/2002 | Lewis et al. |
| 6,491,251 | B1 | 12/2002 | Stanland et al. |
| 6,648,267 | B2 | 11/2003 | Stanland et al. |
| 6,655,629 | B1 | 12/2003 | Acciari |
| 6,786,121 | B2 | 9/2004 | Betti et al. |
| 7,107,888 | B2 | 9/2006 | Blume et al. |
| 7,127,974 | B2 | 10/2006 | Blume et al. |

FOREIGN PATENT DOCUMENTS

| | | |
|---|---|---|
| NL | 8602194 | 3/1988 |

* cited by examiner

CORE REDUCTION APPARATUS

CROSS REFERENCE TO RELATED APPLICATIONS

This application is a continuation of application Ser. No. 10/964,857, filed Oct. 13, 2004 now U.S. Pat. No. 7,127,974, which is a divisional of application Ser. No. 10/384,436, filed Mar. 7, 2003 now U.S. Pat. No. 7,107,888, which applications are incorporated herein by reference.

FIELD OF THE INVENTION

The invention disclosed herein relates to paper roll products with cores, and more particularly to processes and apparatus for reducing the amount of core stock used in paper roll products.

BACKGROUND OF THE INVENTION

Paper roll products, such as toilet tissue rolls and paper towel rolls, typically include a paper web material that is wound around a central core. The core helps to support the paper web material and define the shape of the roll, as well as define a central opening for interaction with a support structure, such as a spindle, on a suitable dispensing apparatus.

In many paper roll products, the core is a one piece structure that extends the entire width of the roll product.

In some known paper roll products, the core is formed by core sections that are spaced apart from each other to form a gap therebetween so that the total length of the core sections is less than the width of the web material wound onto the core sections. See, for example, U.S. Pat. Nos. 3,437,388 and 3,438,589 to Jespersen. The provision of spaced core sections separated by a gap helps to reduce the amount of core stock material that is used, thereby reducing production costs. In some instances, such as in the aforementioned Jespersen patents, the spaced core sections also function to indicate to a user the depletion of the web material from the roll.

There is a continuing need for paper roll products with spaced core sections, and for processes and apparatus used in the production of such paper roll products.

SUMMARY OF THE INVENTION

The invention relates to apparatus and processes for producing paper roll products with spaced core sections. The apparatus and processes described herein can be used to produce paper roll products of the type disclosed in, for example, U.S. Pat. No. 6,491,251.

In accordance with a first aspect of the invention, a process for producing core sections for use in producing paper roll products is provided. The process includes providing a core substrate; arranging the core substrate on a mandrel; dividing the core substrate into a plurality of core sections; and separating at least one core section from an adjacent core section on the mandrel to form a gap therebetween.

Preferably, each core section is separated from an adjacent core section to form a gap between each of the core sections. By separating the core sections, and subsequently winding paper web material onto the core sections, paper roll products with spaced core sections can be produced.

In another aspect of the invention, a process of manufacturing cored paper roll products is provided. The process includes arranging a core substrate on a mandrel; dividing the core substrate into a plurality of core sections; separating the core sections from each other on the mandrel to form a gap between each of the core sections; and winding paper web material onto the core sections.

In yet another aspect of the invention, an apparatus for forming paper roll products is provided. The apparatus includes a mandrel having a longitudinal axis, and a core slitter assembly positioned adjacent the mandrel. The core slitter assembly has a plurality of slitter mechanisms, and the slitter mechanisms are mounted to be moveable between a non-cutting position where the slitter mechanisms are away from the mandrel and a cutting position where the slitter mechanisms are positioned to cut a core substrate disposed on the mandrel into a plurality of core sections. In addition, a plurality of the slitter mechanisms are mounted to be moveable relative to the mandrel in a direction parallel to the longitudinal axis.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DESCRIPTION OF THE DRAWINGS

These and other features of the invention will now be described with reference to the drawings of preferred embodiments, which are intended to illustrate and not to limit the invention and in which.

DETAILED DESCRIPTION OF THE INVENTION

Figure 1A:
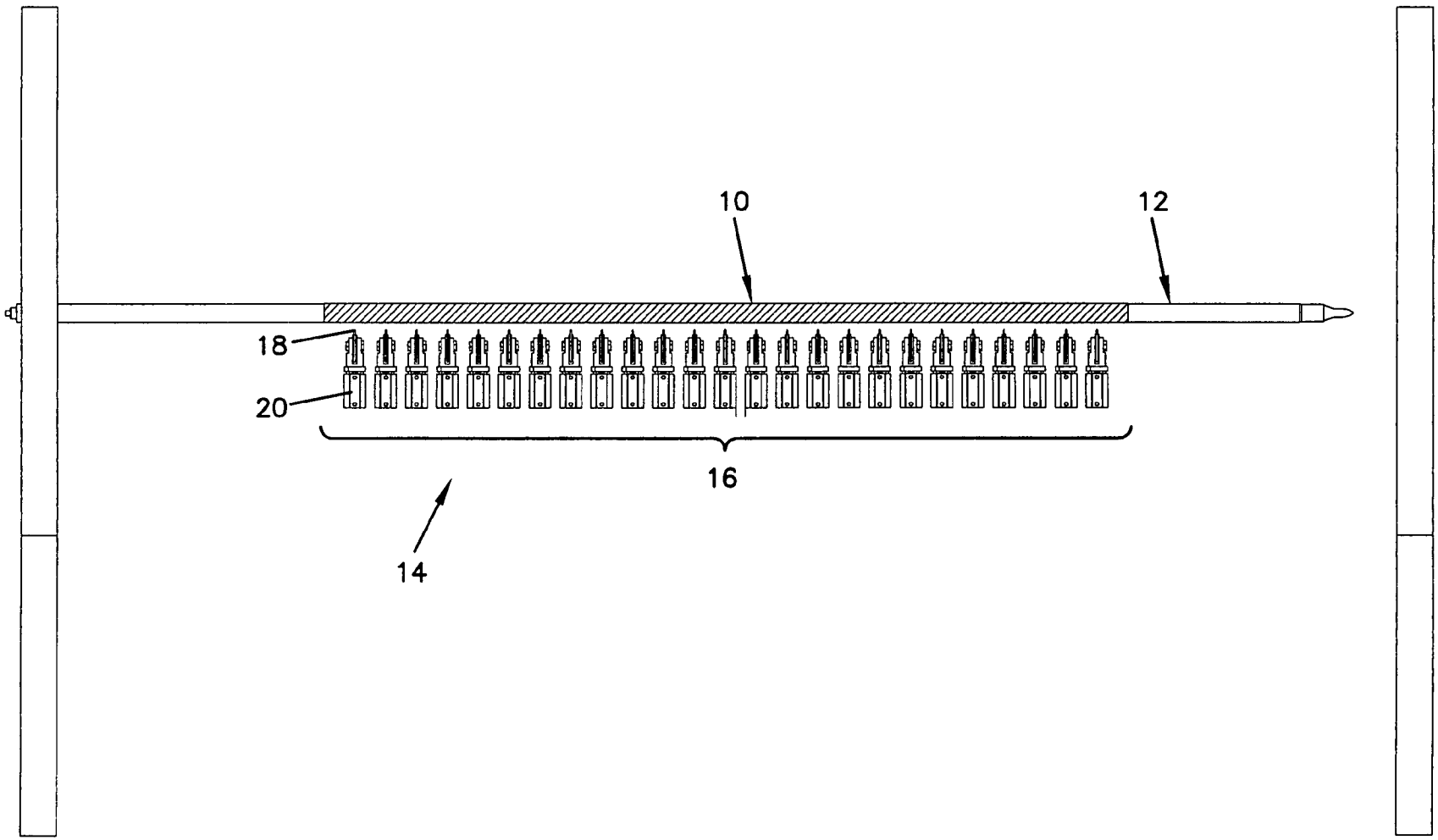
FIG. 1A illustrates a portion of an apparatus for forming paper roll products according to the invention, with a core slitter assembly in the non-cutting position.

With reference to FIG. 1A, a core substrate 10 is illustrated as being disposed on a mandrel 12 of a paper roll production apparatus. A paper roll production apparatus suitable for practicing the invention is the Centrum Center Winder available from Paper Converting Machine Company of Green Bay, Wis. The core 10, which is conventional in construction, is preferably made from cardboard or other suitable paper-based material.

The core substrate 10 is loaded approximately onto the center of the mandrel 12. During loading, the mandrel fingers of the mandrel are retracted to allow loading. Once the core substrate 10 is in position, the mandrel fingers are extended in order to hold the core substrate in place. The use of mandrel fingers and their extension and retraction are known in the art. For example, see U.S. Pat. No. 4,635,871. The mandrel 12 is mounted in known fashion so as to be rotatable in order to wind paper web material onto core sections formed from the core substrate 10.

Positioned adjacent the mandrel 12 is a core slitter assembly 14 according to the invention. The core slitter assembly 14 comprises a plurality of slitter mechanisms 16 that are configured to cut the core substrate 10 into a plurality of core sections. To accomplish cutting, each slitter mechanism 16 comprises a slitting head that includes a cutting disk 18, and a slitter cylinder 20 for actuating the slitting head toward and away from the mandrel 12. The cylinder 20 can be a pneumatic or hydraulic cylinder.

Figure 1B:
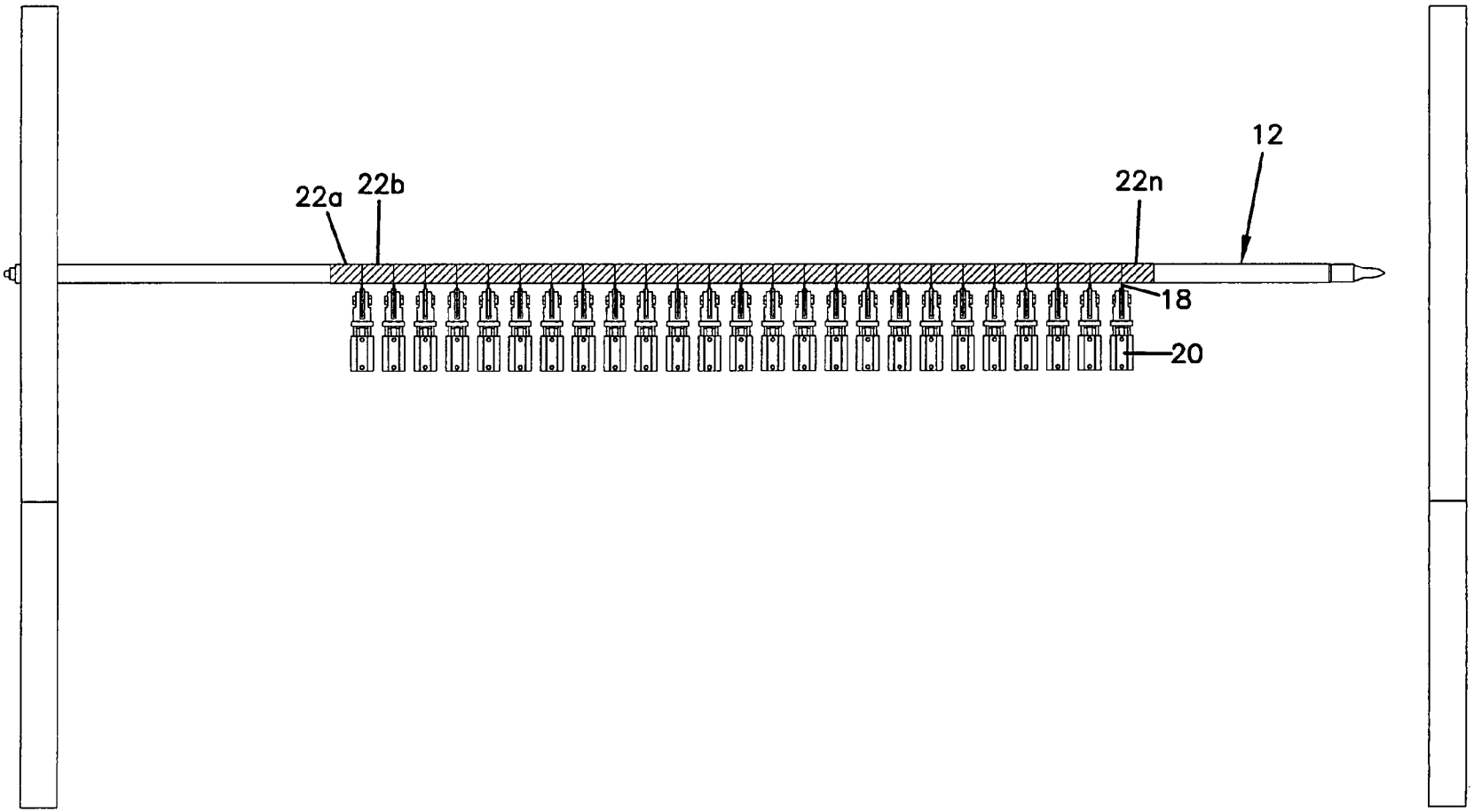
FIG. 1B illustrates the slitter mechanisms of the core slitter assembly in the cutting position to divide the core substrate into a plurality of core sections.

In FIG. 1A, the cylinders 20 are disengaged so that the slitting heads are retracted to permit loading of the core substrate on the mandrel 12. In FIG. 1B, the cylinders 20 are engaged to extend the slitting heads and the cutting disks 18 toward the mandrel 12 into cutting position for cutting the core substrate 10 into a plurality of core sections 22*a, b, . . . n.*

To achieve cutting, the mandrel 12 is rotated while the cutting disks 18 are engaged with the core substrate 10. During cutting, the mandrel fingers are preferably extended to assist in holding the core substrate, and the resulting core sections 22*a . . . n*in place on the mandrel. Driven back-up rollers 24*a*, 24*b* (shown in FIG. 7) can also be used to assist the cutting process and limit bowing of the mandrel 12 during cutting.

The cutting disks 18 are shown as being oriented in a plane substantially perpendicular to the central axis of the mandrel 12 so that the cuts in the substrate 10 are made in a plane substantially perpendicular to the mandrel axis. However, the cutting disks 18 could be oriented so that the cuts that are made are slanted or angled relative to the mandrel axis.

In the preferred embodiment, the resulting core sections 22*a . . . n* each have a length that is approximately ⅔ of the desired width of the finished paper roll product. Other core section lengths could be used.

Mechanisms other than cutting disks 18 could be used to divide the substrate 10 into core sections 22*a . . . n.* For example, water jets or other industry methods could be used to divide the substrate into the core sections. After the substrate is divided into the core sections 22*a . . . n,* the core sections are separated from each other to form a gap between each core section.

With reference to FIGS. 2-5, further details of the slitter assembly 14 are illustrated. The slitter assembly 14 comprises first and second halves 15*a*, 15*b* each of which comprises a plurality of slitter mechanisms 16, as best seen in FIGS. 2A and 2B. Each slitter assembly half 15*a*, 15*b* is provided with an adjustment mechanism 25*a*, 25*b* that is connected to the slitter mechanisms 16. The adjustment mechanisms 25*a*, 25*b* are each configured and arranged to actuate the slitter mechanisms 16 in a direction parallel to the longitudinal axis of the mandrel 12. Each slitter mechanism 16 is also configured and arranged to engage a core section such that when the slitter mechanisms are moved in a direction parallel to the mandrel 12, the core section 22*a . . . n* engaged by the respective slitter mechanism 16 moves with the slitter mechanism to achieve separation of the core sections.

Figure 6:
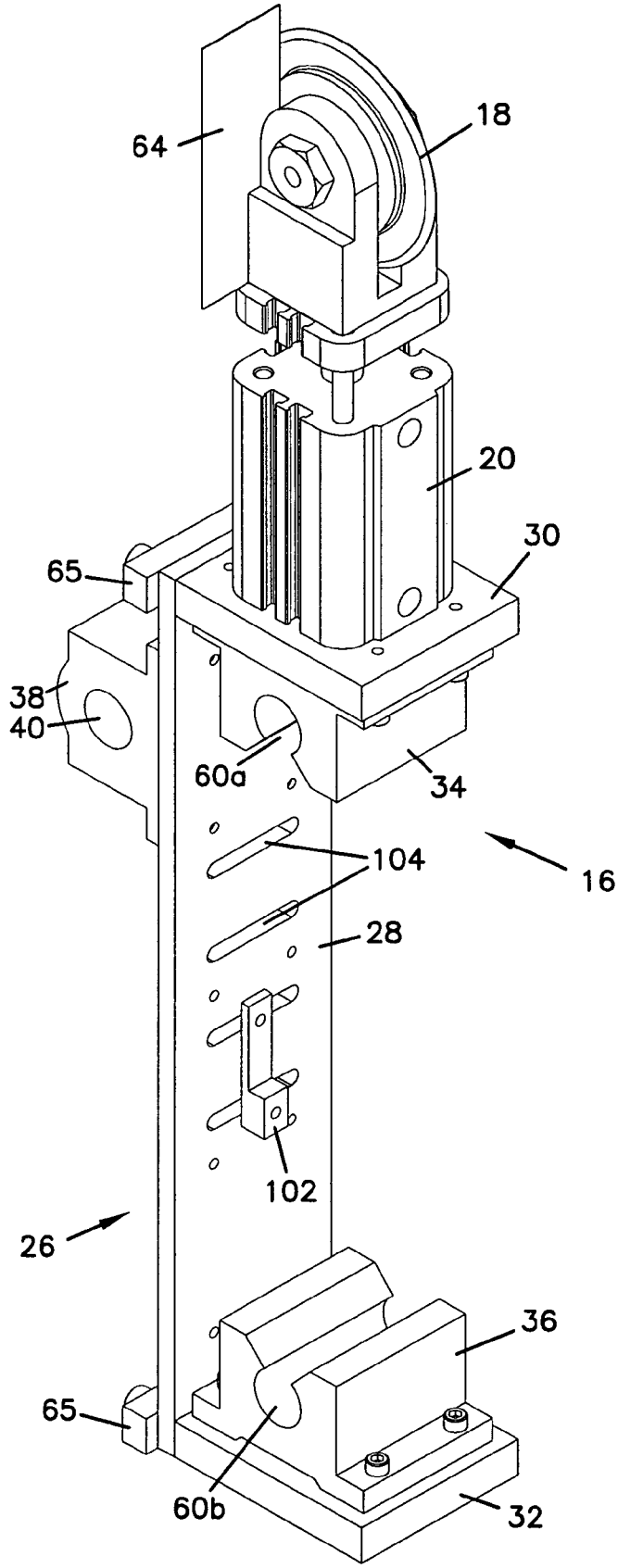
FIG. 6 illustrates a slitter mechanism in detail.

FIGS. 6-9 illustrate one of the slitter mechanisms 16 in detail, it being understood that the other slitter mechanisms are substantially identical. The slitter mechanism 16 includes a support bracket 26 comprising a support plate 28 and first end plate 30 and a second end plate 32. As shown in FIG. 6, the slitter cylinder 20 is mounted to one side of the end plate 30. In addition, a pair of bearing pads 34, 36 are mounted on the facing surfaces of the end plates 30, 32. Further, a slide block 38 defining a central opening 40 is fixed to the support plate 28. The purpose of the bearing pads 34, 36 and slide block 38 will become apparent later in the description.

Figure 2A:
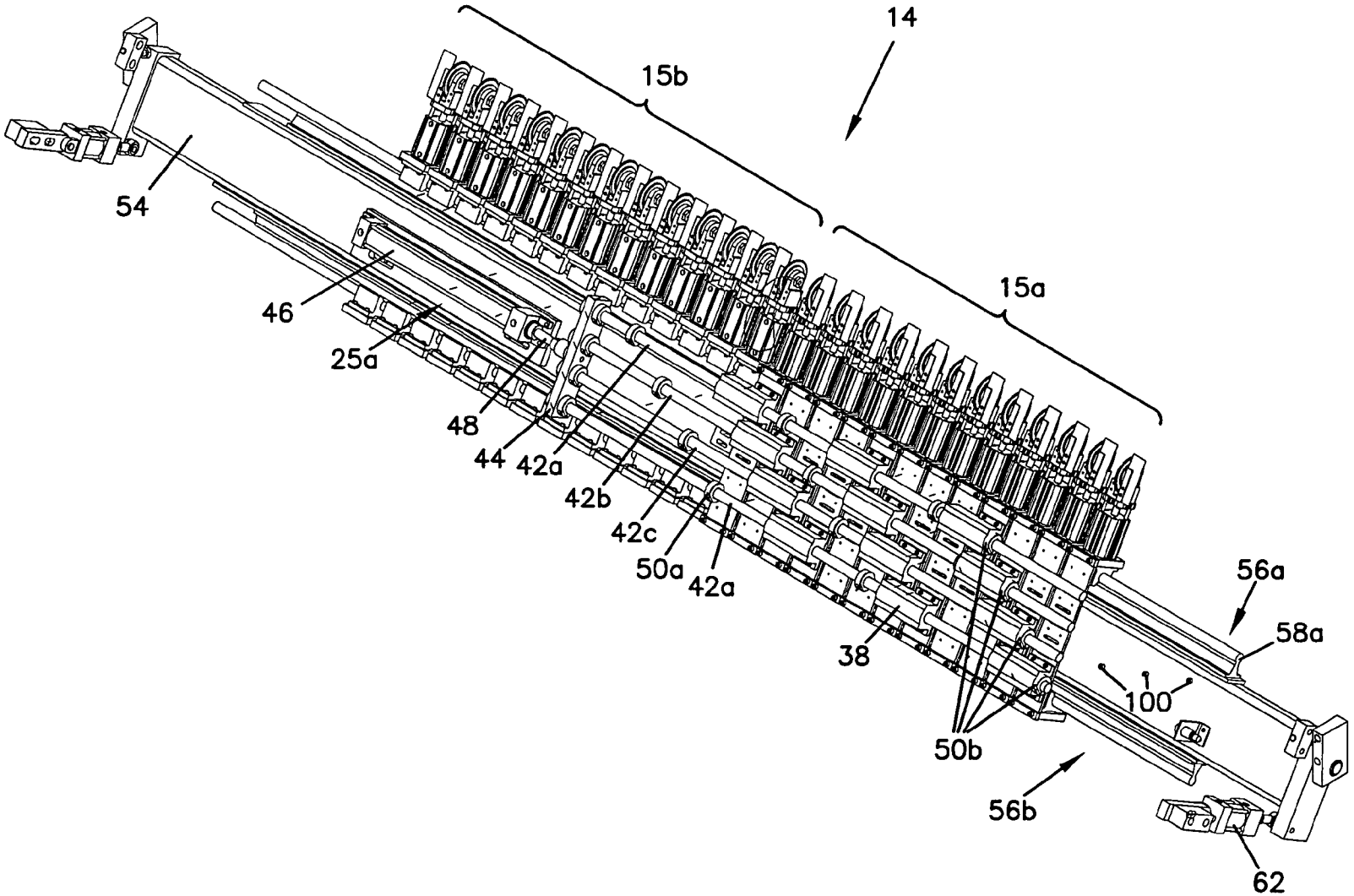
FIG. 2A is a perspective view of the core splitter assembly and an adjustment mechanism for one-half of the slitter mechanisms of the assembly.
Figure 2B:
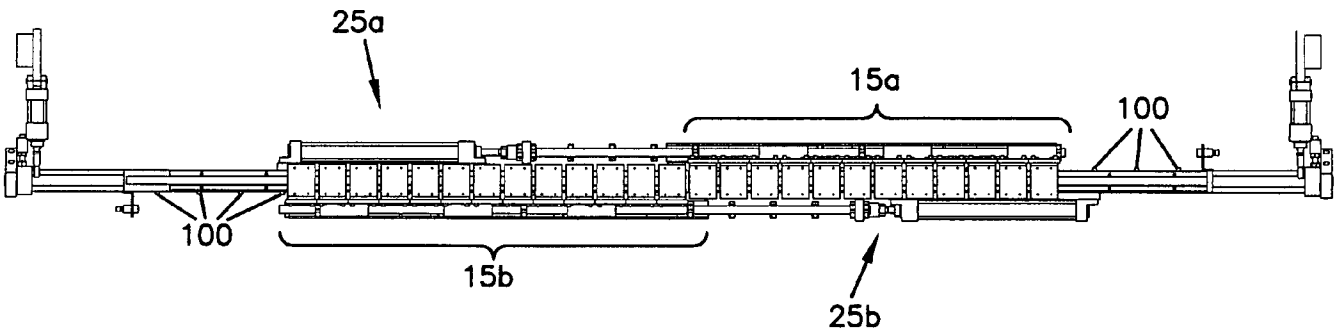
FIG. 2B is a bottom view of the core splitter assemblies showing each adjustment mechanism for each half of the slitter mechanisms.
Figure 3:
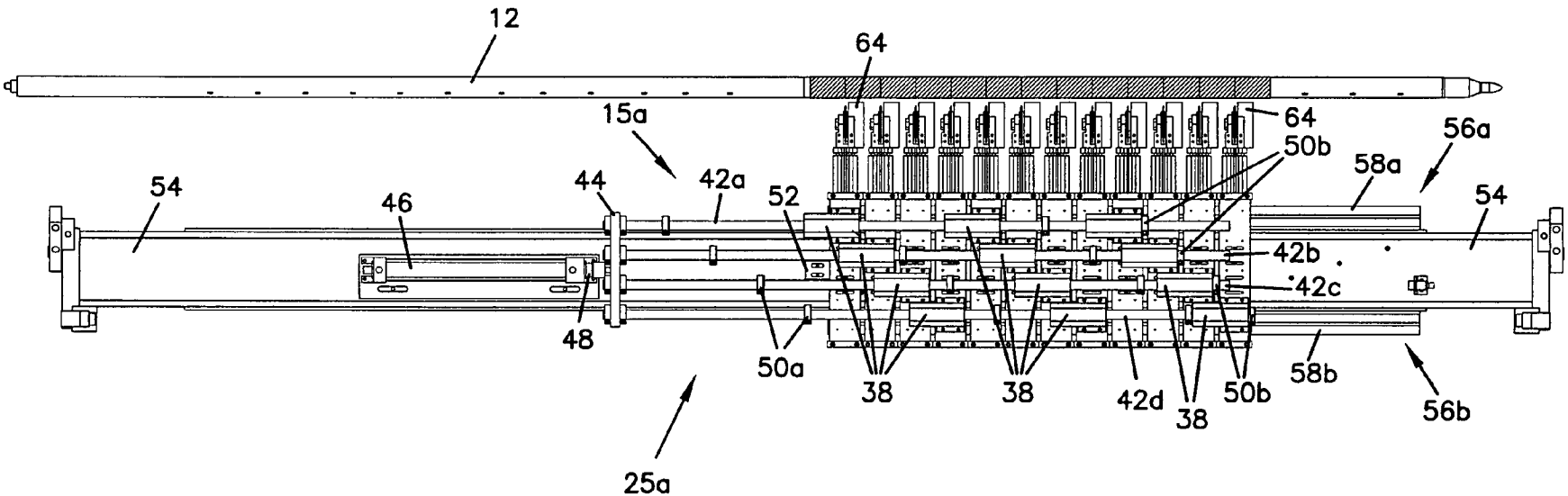
FIG. 3 illustrates one-half of the slitter assembly with the slitter mechanisms disengaged from the core sections along with an adjustment mechanism.

With reference to FIGS. 2A, 2B and 3, the adjustment mechanism 25*a* will be described in detail. FIG. 3 shows only the slitter assembly half 15*a* and its associated adjustment mechanism 25*a,* with the half 15*b* being removed for clarity. It is to be understood that, in operation, the slitter assembly half 15*b* would be positioned to the left of the half 15*a* in FIG. 3, and that the core substrate would extend to the left in FIG. 3 around the mandrel 12 to be engaged by the slitter assembly half 15*b*. In addition, it is to be understood that the adjustment mechanism 25*b* is identical in construction and function to the adjustment mechanism 25*a*, but is positioned on the opposite side of the slitter assembly 14 from the adjustment mechanism 25*a* as shown in FIG. 2B.

The adjustment mechanism 25*a* comprises, in the illustrated embodiment, four rods 42*a-d*, the adjacent ends of which are fixed to a yoke 44. An actuating cylinder 46 has an actuating rod 48 that is fixed to the yoke 44 approximate the center thereof. The cylinder 46, which can be either pneumatically or hydraulically actuated, extends or retracts the rod 48, which moves the yoke 44 in a direction parallel to the longitudinal axis of the mandrel 12. Movement of the yoke 44 causes movement of the rods 42*a-d*, which in turn results in movement of the slitter mechanisms 16.

In the illustrated embodiment of the slitter assembly half 15*a,* there are three slitter mechanisms 16 disposed on each rod 42*a-d,* with the rods extending through the openings 40 in the slide blocks 38 of the respective slitter mechanisms. As shown in FIGS. 2A and 3, the slide blocks 38 of adjacent slitter mechanisms 16 are positioned at different locations along the length of the support plates 28. However, the position of the slide blocks 38 of the three slitter mechanisms on each rod 42*a-d* are positioned at the same position on the support plates 28.

The number of rods 42*a-d* and the number of slitter mechanisms 16 on each rod can vary depending upon the number of slitter mechanisms that are provided. In the illustrated embodiment, the slitter assembly half 15*b* includes 13 slitter mechanisms, so that one of the actuating rods associated therewith will have a different number of slitter mechanisms thereon compared to the other actuating rods.

A plurality of actuators comprising extension actuators 50*a* and retraction actuators 50*b* are fixed to and move integrally with the rods 42*a-d*. The actuators 50*a*, 50*b* can comprise collars that are clamped onto the respective rods 42*a-d*. There is one extension actuator 50*a* positioned to the left of each slide block to engage the left sides of the slide blocks 38 when the rods 42*a-d* move, thereby causing the slitter mechanisms to move to the left to a separated configuration (when viewing FIGS. 3-5). The separated configuration and the engagement of the extension actuators 50*a* with the left sides of the slide blocks are illustrated in FIG. 5.

In addition, there is one retraction actuator 50*b* disposed on each rod 42*a-d*, with each actuator 50*b* being positioned to the right (when viewing FIGS. 3-5) of the rightmost slitter mechanism 16 on each rod 42*a-d*. As a result, when the rods 42*a-d* are retracted, the retraction actuators 50*b* engage the right sides of the rightmost slide blocks to initiate return of the slitter mechanisms to a home position. Blocks 65 (best seen in FIG. 6) adjacent the top and bottom of the support plates 28 of the rightmost slitter mechanism 16 on each rod 42*a-d* engage the next adjacent slitter mechanism 16 as the rods continue to retract. Similar blocks are on the remaining slitter mechanisms, whereby as the rods retract, the slitter mechanisms stack up as they are pulled back to the home position. The home position, the engagement of the retraction actuators 50*b* and the slide blocks, and a small gap between each slitter mechanism due to the blocks 65 is illustrated in FIG. 3. A stop 52 that is fixed to a frame (discussed below) is provided to contact the leftmost slitter mechanism 16 to define the home position for the slitter mechanisms.

The actuators 50*a*, 50*b* are configured and arranged to effect sliding movement of the slitter mechanisms 16 on the rods 42*a-d* from the home position shown in FIG. 3 to the separated configuration shown in FIG. 5, and back again to the home position with the aid of the blocks 65. The positioning of the actuators 50*a*, 50*b* on the rods 42*a-d* is such as to achieve equal spacing of the slitter mechanisms 16 in the separated configuration as shown in FIG. 5. The distance each slitter mechanism will move is the difference between the stroke of the cylinder 46 and each slide block's distance to the respective actuator 50*a*.

Figure 4:
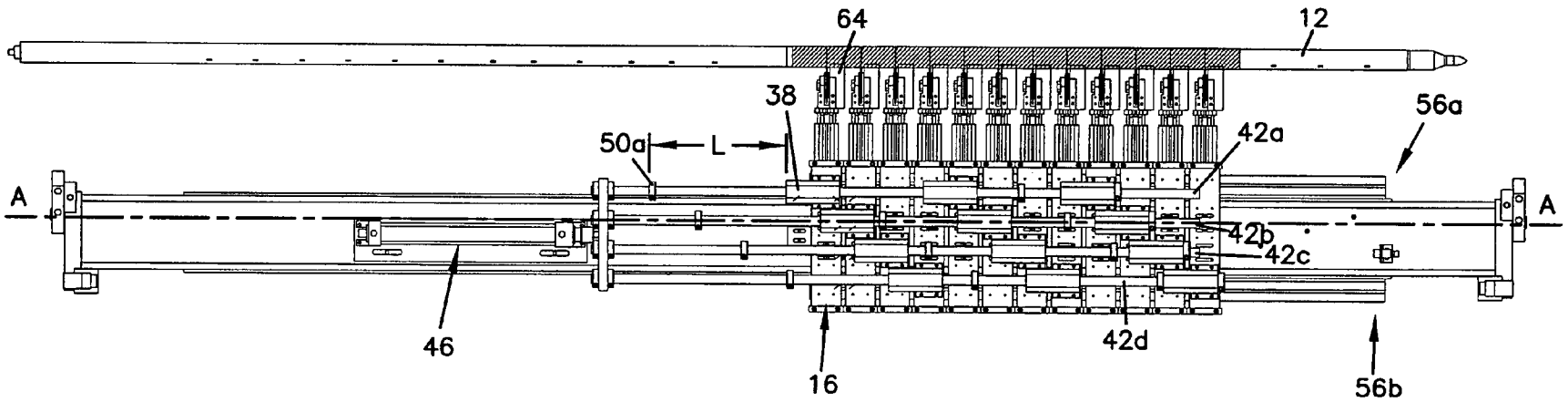
FIG. 4 illustrates the gripper mechanisms of the slitter mechanisms engaged with the core sections.
Figure 5:
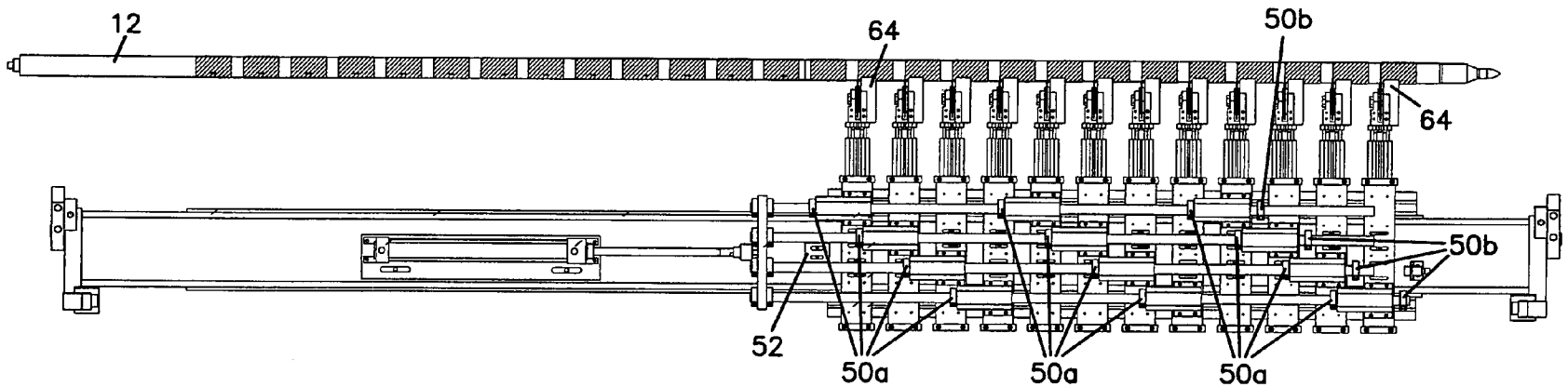
FIG. 5 illustrates the slitter mechanisms moved relative to the mandrel to space the core sections from each other.

With reference to FIGS. 2A, 3, and 4, stops 100 are fixed to a frame 54 (to be later described) on each side thereof. There is one stop 100 for each slitter mechanism 16 of each of the slitter assembly halves 15*a*, 15*b*. Each slitter mechanism 16 includes a stop block 102, shown in FIG. 6, that is fixed to the plate 28 at a location for engagement with one of the stops 100. Each stop block 102 is adjustable upward and downward vertically on the respective plate 28 through the use of bolts that extend through slots 104 in the plate 28 for adjusting the vertical position of the block 102.

The shape and position of the blocks 102 on the slitter mechanisms 16 are such that the blocks 102 engage a respective stop 100 once the slitter mechanisms 16 have been pushed into the separated configuration by the rods 42*a-d*, as shown in FIG. 5 for the slitter mechanisms 16 of the slitter assembly half 15*a*. The engagement between the blocks 102 and the stops 100 prevents the slitter mechanisms 16 from floating or moving further after they have been actuated into their separated positions.

With reference to FIG. 4, the distance L between the right side of the actuator 50*a* and the left side of the slide block 38 for the leftmost slitter mechanism 16 on the rod 42*a* is illustrated. The distance L defines the distance the actuator 50*a* must move in order to cause movement of the slitter mechanism 16. This distance gets smaller for rod 42*b*, smaller again for rod 42*c*, and smaller again for rod 42*d*. Similar distance relationships exist for the other actuators 50*a* and slide blocks on the rods 42*a-d*. Thus, a single stroke of the cylinder 46 moves the slitter mechanisms 16 to the positions shown in FIG. 5.

Figure 7:
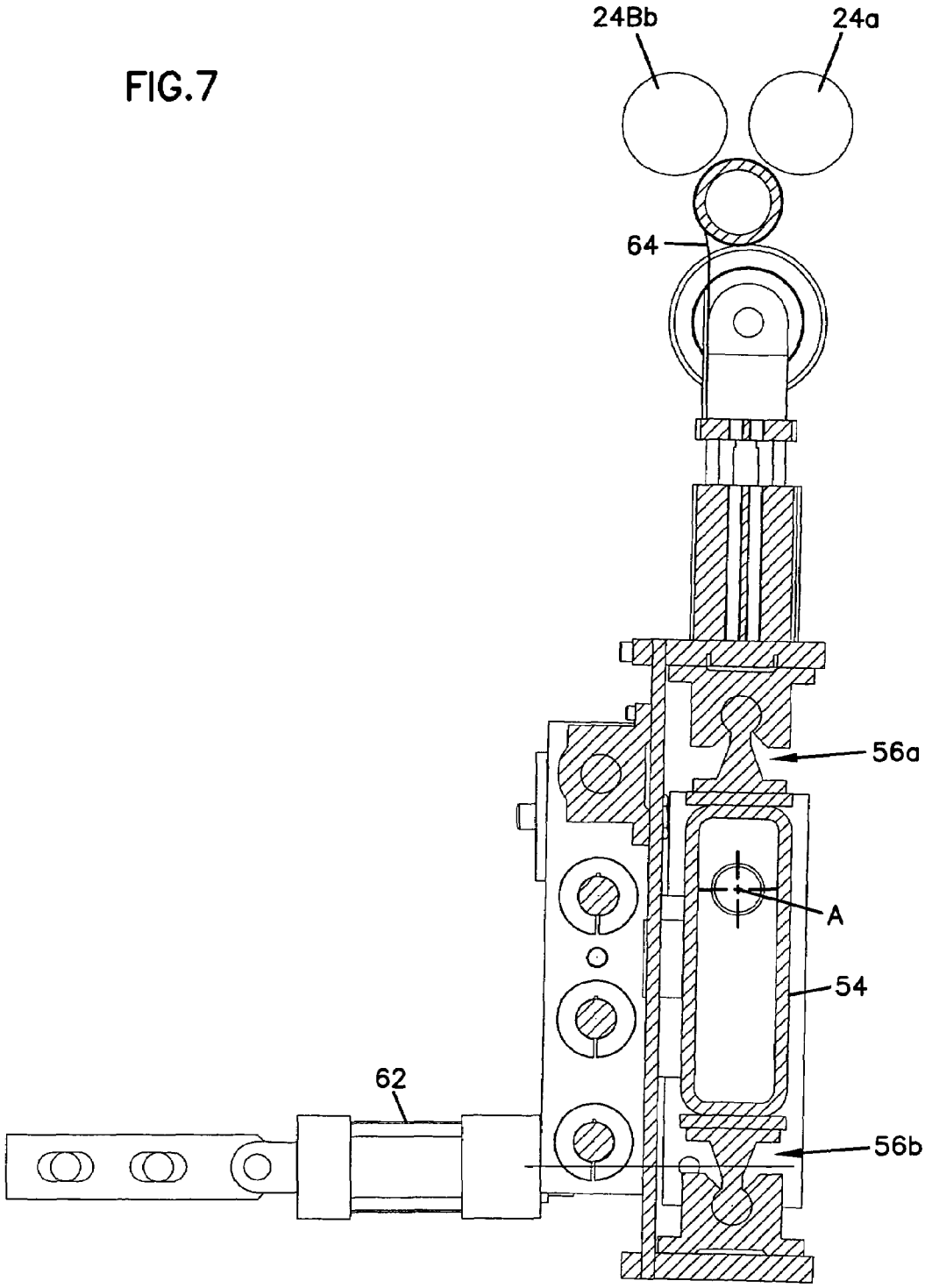
FIG. 7 illustrates pivoting of the slitter mechanism to engage the gripper mechanism with the respective core section.

The slitter mechanisms 16 are configured and arranged to engage the core sections so that the core sections move with the slitter mechanisms. The means for engaging and separating the core sections will now be described with reference to FIGS. 7-8 along with FIGS. 2-6. As shown in FIGS. 2A, 3 and 7, a rectangular frame 54 extends approximately the entire length of the mandrel 12 parallel thereto. The frame 54 is mounted for pivoting movement about a pivot axis A shown in FIGS. 4 and 7. As shown in FIGS. 2A and 3, the cylinder 46 is mounted to the side of the frame 54.

Slide rails 56*a*, 56*b* are fixed at the top and bottom of a portion of the frame 54. The slide rails 56*a*, 56*b* include rounded edges 58*a*, 58*b* that are received within rounded pockets 60*a*, 60*b* formed in the bearing pads 34, 36 of the slitter mechanisms 16. The slide rails 56*a*, 56*b* within the pads 34, 36 permit sliding movement of the slitter mechanisms 16 relative to the frame 54. A pivot cylinder 62 is connected to the frame to cause pivoting movement of the frame 54, and the slitter mechanisms 16 disposed thereon, about the pivot axis A.

The disks 18 are used to affect separation of the core sections by pushing the core sections into place as the rods 42*a-d* are actuated by the cylinder 46. To facilitate sliding of the disks 18 relative to the mandrel 12 after the disks have cut the core sections 22*a* . . . *n*, the pressure in the cylinders 20 is lowered from that used during the cutting phase. For example, during cutting of the core substrate 10 by the disks 18, the pressure in the cylinders 20 is about 60 psi, which is reduced to about 10 psi when the disks 18 push the core sections.

Figure 8:
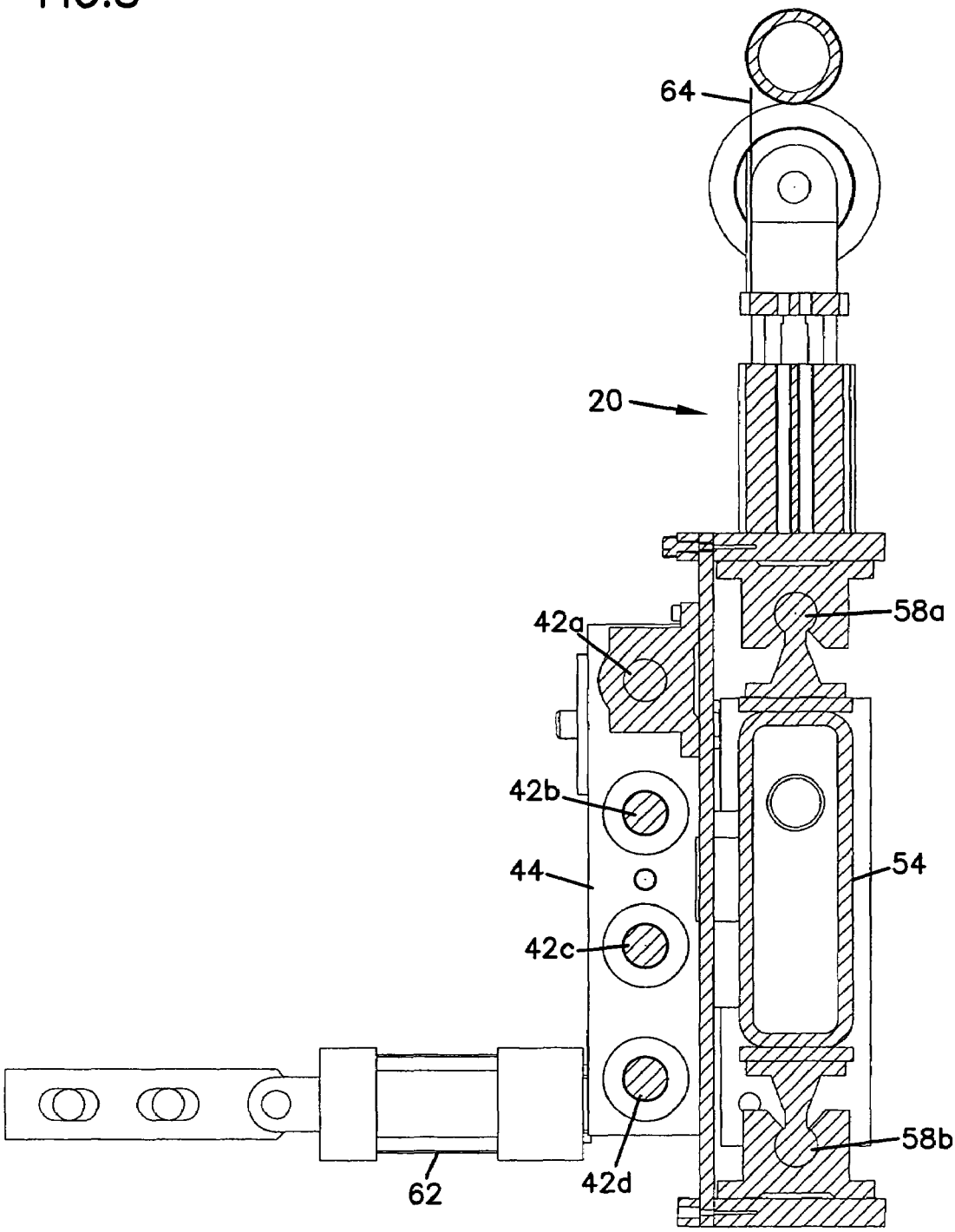
FIG. 8 illustrates a position of the slitter mechanism where the gripper mechanism does not engage the core section.
Figure 9:
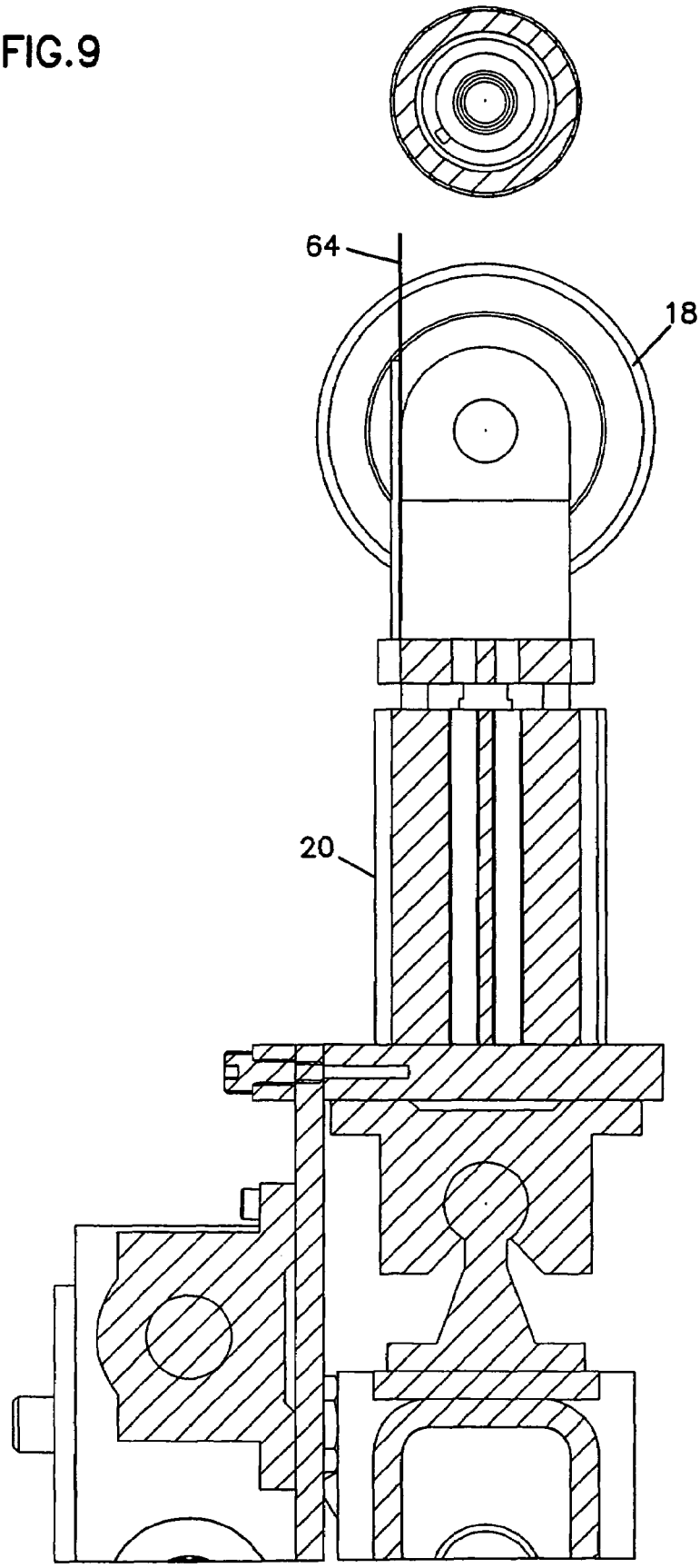
FIG. 9 illustrates a slitter mechanism in the non-cutting position.

With reference to FIG. 6, the slitter mechanism 16 includes a gripper mechanism 64 that is configured and arranged to engage a core section 22*a* . . . *n* as the slitter mechanism 16 moves along the respective rod 42*a-d*. In the illustrated embodiment, the gripper mechanism 64 comprises a plate that is made of a flexible material, such as spring steel. The plate is disposed adjacent the disk 18 and projects beyond the end of the disk 18, as shown in FIGS. 7-9. To increase friction between the gripper mechanism 64 and the core section, barbs or other friction enhancing features could be provided on the gripper mechanisms. The gripper mechanisms 64 apply light pressure to the core sections to prevent the core sections from sliding after the disks 18 have pushed them into position.

The operation of the entire apparatus will now be described. Initially, with the cylinder 20 disengaged, a core substrate 10 is loaded onto the mandrel 12. With the cylinder 20 disengaged, the disk 18 and gripper mechanism 64 are away from the mandrel 12, which permits loading of the core substrate without interference from the disk 18 or gripper mechanism 64 (see FIGS. 1 and 9). Once the core substrate is in position, the cylinder 20 is engaged while the pivot cylinder 62 is extended. This brings the disks 18 into position to cut the core substrate 10 into the core sections (see FIGS. 2 and 8). The mandrel 12 is then rotated at least one full revolution, so that the disks 18 cut the core substrate 10 into the core sections.

With the pivot cylinder 62 extended, the gripper mechanism 64 is not engaged with the core substrate (see FIG. 8). With the cylinder 20 still engaged, the pivot cylinder 62 is retracted which pivots the frame 54 and the slitter mechanisms 16 of both slitter assembly halves 15*a*, 15*b* in a clockwise direction around the pivot axis. This movement brings the gripper mechanisms 64 into engagement with the core sections while maintaining the disks 18 in engagement with the core sections (see FIGS. 4 and 7). With the gripper mechanisms engaged with the core sections, the cylinder 46 of each actuating mechanism 25*a*, 25*b* is then actuated to move the slitter mechanisms 16 parallel to the mandrel 12. With reference to FIG. 2A, the slitter mechanisms 16 of the slitter assembly halve 15*a* will be moved to the right, while the slitter mechanisms 16 of the slitter assembly halve 15*b* will be moved to the left. The core sections are moved by the disks 18, thereby separating the core sections on the mandrel 12 (see FIG. 5). After the core sections are moved, the mandrel fingers will again be engaged in order to hold the core sections in place during winding of the web material.

As described above, each core section 22*a* . . . *n* preferably has a length that is approximately ⅔ of the desired width of the finished paper roll product. Further, it is preferred that the gap that is formed between each core section after separation is substantially ⅓ of the width of the finished paper roll product.

Figure 10:
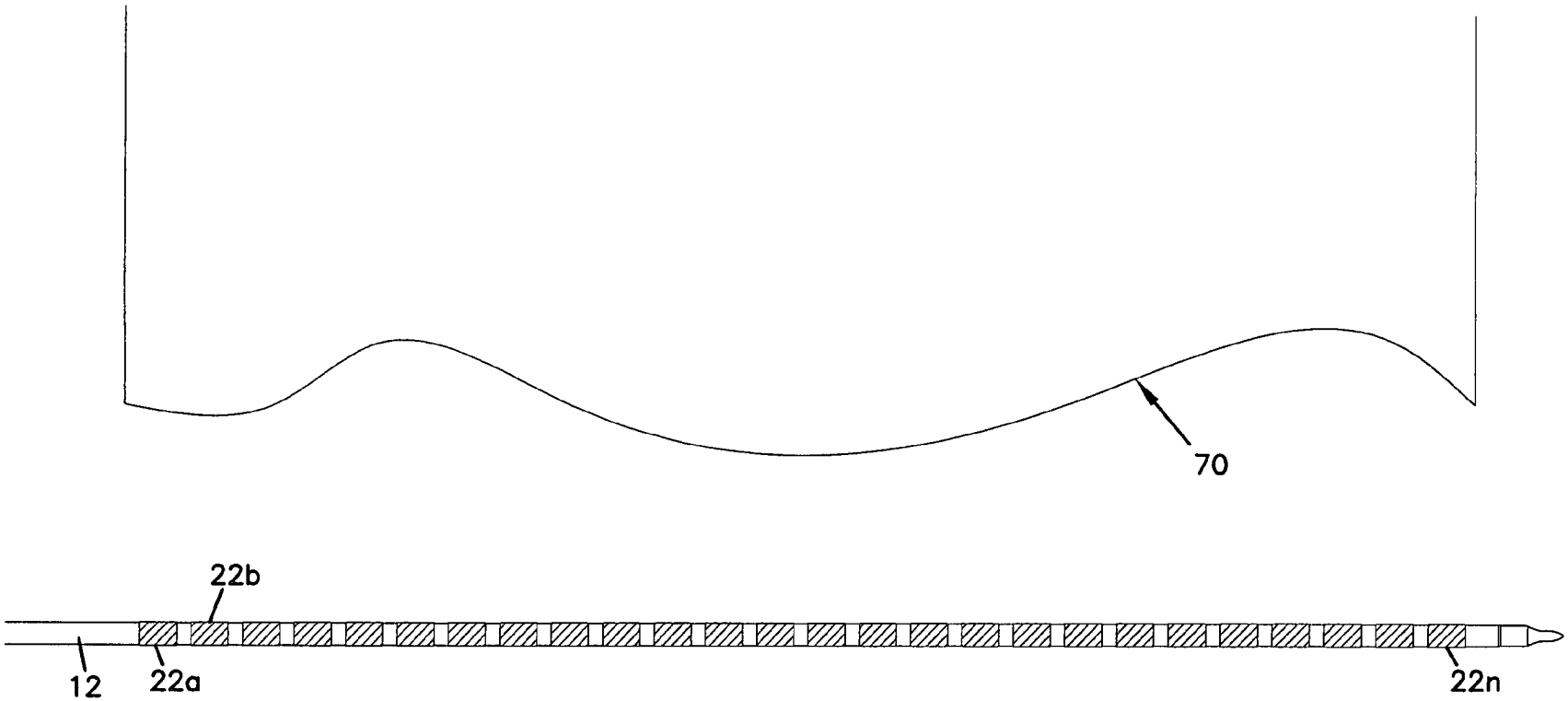
FIG. 10 illustrates the web material prior to beginning winding onto the spaced core sections.

Turning to FIG. 10, once the core sections are separated, a paper web material 70 is then wound onto the core sections by rotating the mandrel 12 until a desired thickness is achieved. The paper web material is preferably toilet tissue. However, other paper webs could be used, for example paper towels and other paper products that are wound onto cores.

Figure 11:
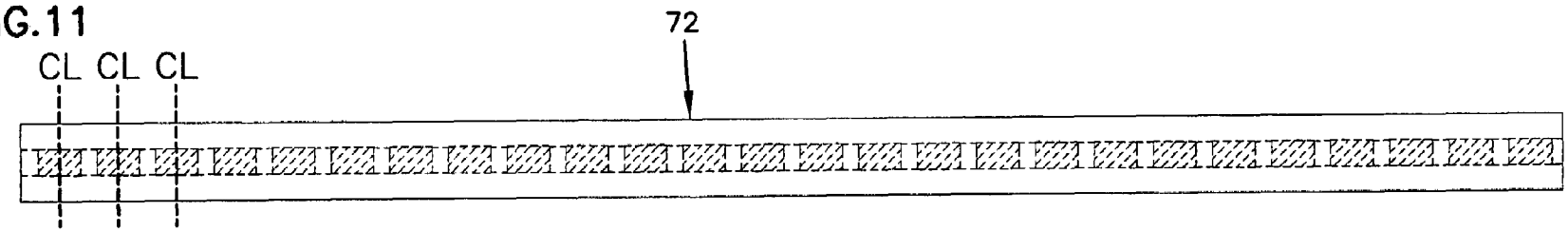
FIG. 11 illustrates a log of paper roll products after winding and after being removed from the mandrel.

Once the desired thickness is achieved, the now formed log 72 of rolls is removed from the mandrel 12, as shown in FIG. 11. The log 72 is then cut approximately through the center of each core section along cut lines CL as shown in FIG. 11. The log 72 is preferably saw cut, although other cutting techniques could be used as well.

Figure 12:
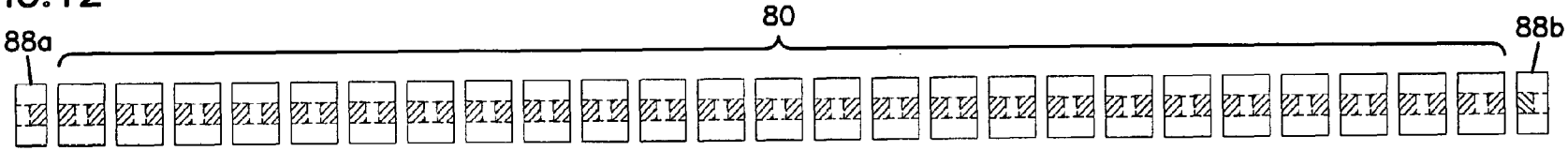
FIG. 12 illustrates a plurality of paper roll products after cutting the log.
Figure 13:
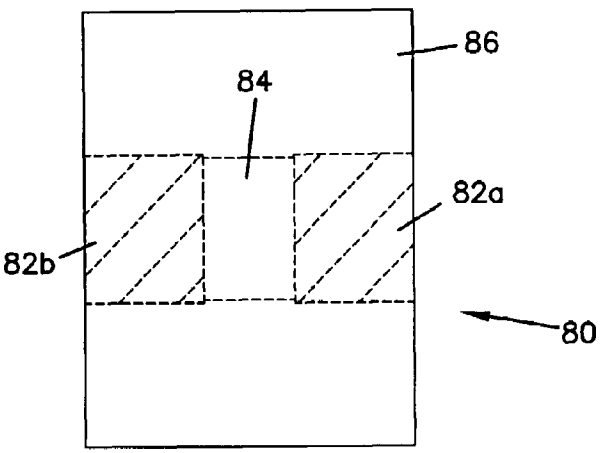
FIG. 13 illustrates a paper roll product produced according to the invention.

The result, as illustrated in FIGS. 12 and 13, is a plurality of finished paper roll products 80, each of which comprises a pair of core sections 82*a*, 82*b* that are spaced apart from one another by a gap 84 approximate the center of the product 80, and paper web material 86 wound onto the core sections 82*a*, 82*b*. A pair of scrap rolls 88*a*, 88*b* are formed at the ends of the log, which can be recycled or thrown away.

Many other configurations and methods could be used to produce a paper roll product according to the principles of the invention. For example, the web 70 could be slit as the web is being wound onto the mandrel 12. At the same time, slitters could be used to cut the core sections during winding to cut the core sections to correct size. This would eliminate the need for a log saw to cut a log down into separate roll products.

In addition, the gap 84 between the core sections 82*a*, 82*b* could be closer to one end of the product 80 than the other end. Further, the product could be formed with only one core section, in which a gap would exist at one end of the product or, if the single core section is located between the ends of the product, gaps would exist at each end.

Moreover, rather than separating the core sections after cutting the core substrate, the core substrate could be cut into full length cores and then a slitter could cut the gap section out of the full length core section. The cut section would then be cut away from the mandrel and then recycled.

Instead of using the disks to separate the core sections, the gripper mechanisms 64 could be used to achieve core section separation. In this embodiment, the disks would disengage from the core sections when the pivot cylinder 62 retracts, and the gripper mechanisms would need to be designed to engage the core sections with sufficient force to achieve separation.

Further, gripping mechanisms other than plates could be used, for example plastic or rubber fingers with or without friction enhancing features such as barbs. Further, instead of pivoting the frame 54, the gripper mechanisms themselves could be provided with separate actuators to affect engagement with the core sections.

The embodiments of the inventions disclosed herein have been discussed for the purpose of familiarizing the reader with novel aspects of the invention. Although preferred embodiments have been shown and described, many changes, modifications, and substitutions may be made by one having skill in the art without necessarily departing from the spirit and scope of the invention.

We claim:

1. An apparatus for forming paper roll products, comprising:

a core slitter assembly having a plurality of slitter mechanisms, each slitter mechanism including a cutting disc and a gripper mechanism, and the slitter mechanisms are mounted to be moveable between a non-cutting position wherein the slitter mechanisms are away from a core substrate, a cutting position wherein the slitter mechanisms are positioned to cut the core substrate into a plurality of core sections, and a gripper engagement position wherein the gripper mechanisms engage the core sections, the plurality of slitter mechanisms are mounted to be moveable in a direction parallel to a longitudinal axis of the core substrate to space apart the core sections along the longitudinal axis.

2. The apparatus according to claim 1, further comprising a mandrel and an adjustment mechanism, the adjustment mechanism configured to move the slitter mechanisms relative to the mandrel in a direction parallel to the longitudinal axis, and the mandrel configured to support the core substrate.

3. The apparatus according to claim 1, wherein the gripper mechanisms comprise a plate that is fixed to the slitter mechanism adjacent to the cutting disc.

4. The apparatus according to claim 3, wherein the plate comprises a flexible material.

5. The apparatus according to claim 3, wherein the plate extends distally beyond a distal end of the cutting disc.

6. The apparatus according to claim 3, wherein the gripper mechanisms include friction enhancing members on a surface of the gripper mechanisms that engages the core section.

7. The apparatus according to claim 3, wherein the gripper mechanisms are configured to hold the core sections in the spaced apart orientation.

8. The apparatus according to claim 1, wherein the slitter mechanisms are configured to cut the core substrate and to space apart the core sections prior to a webbing material being mounted to the core sections.

* * * * *